US005340105A

United States Patent [19]

Gostyla

[11] Patent Number: 5,340,105

[45] Date of Patent: Aug. 23, 1994

[54] COUNTER ROTATING POINTER AND DISC CHANCE DEVICE

[76] Inventor: Bernie J. Gostyla, 51 W. St., Bloomfield, Conn. 06002

[21] Appl. No.: 124,593

[22] Filed: Sep. 22, 1993

[51] Int. Cl.[5] ..... A63F 5/04

[52] U.S. Cl. ..... 273/142 R; 273/141 R

[58] Field of Search ..... 273/274, 138 R, 141 R, 273/141 A, 142 R, 142 A, 142 J, 142 JA, 142 JC, 142 HA, 142 K

[56] References Cited

U.S. PATENT DOCUMENTS

| | | | |
|---|---|---|---|
| 1,800,285 | 4/1931 | Dowling | 273/141 R |
| 1,809,098 | 6/1931 | Zieleg et al. | 273/141 R |
| 3,759,524 | 9/1973 | McNaney | 273/142 R |
| 3,861,686 | 1/1975 | Breslow et al. | 273/141 R |
| 4,206,921 | 6/1980 | Luehr | 273/142 D |
| 4,906,005 | 3/1990 | Manabe | 273/142 R |
| 4,911,448 | 3/1990 | Thomas | 273/142 R |
| 4,941,665 | 7/1990 | Klamer | 273/142 R |

FOREIGN PATENT DOCUMENTS

| | | | |
|---|---|---|---|
| 0217266 | 7/1942 | Switzerland | 273/142 |

*Primary Examiner*—Vincent Millin
*Assistant Examiner*—William M. Pierce
*Attorney, Agent, or Firm*—Gary A. Culliss

[57] ABSTRACT

A rotatable gaming device for randomly selecting data through analog means. The device includes a base assembly which supports a rotatable platform having a plurality of indicia thereon. A rotatable center shaft projects through the platform and supports a cup member at a top end thereof. A point is secured to the center shaft in a plane parallel to that defined by the rotatable platform. The device may be utilized for playing a game in which a bet, such as poker chips, money, or the like, is placed in the cup and the pointer is caused to rotate with respect to the platform, whereby a portion of the bet may be won by opposing players as a result of the relative placement of the pointer with respect to the platform indicated by the indicia upon a termination of the motion. Alternate embodiments of the present invention include additional gaming covers which may be magnetically engaged to the rotatable platform to change the indicia contained thereon and a storage compartment for storing such additional gaming covers.

10 Claims, 4 Drawing Sheets

COUNTER ROTATING POINTER AND DISC CHANCE DEVICE

BACKGROUND OF THE INVENTION

1. Field of the Invention

The present invention relates to chance devices and more particularly pertains to a rotatable gaming device for randomly selecting data through analog means.

2. Description of the Prior Art

The use of chance devices is known in the prior art. More specifically, chance devices heretofore devised and utilized for the purpose of generating randomly selected data are known to consist basically of familiar, expected and obvious structural configurations, notwithstanding the myriad of designs encompassed by the crowded prior art which have been developed for the fulfillment of countless objectives and requirements.

For example, a rotator game device is illustrated in U.S. Pat. No. 4,941,665 which has a circular housing with a recess and a base wheel rotatable within the housing recess upon a bearing arrangement. The device further includes a plurality of wheel or disk members carrying indicia such that when the base wheel is stationary the plurality of wheel members are urged under the influence of gravity to a nested relationship, and when the base wheel is rotating the wheel members are displaced outwardly under the influence of centrifugal force such that their outer edge contacts the lip of the circular container, thereby causing the wheel members to revolve. Storage compartments can be provided for storing the wheels or disks.

A roulette playing device is disclosed in U.S. Pat. No. 4,906,005 which includes a hitting device for releasing a ball onto a circular runway which comprises a first rotatable roller disposed upstream of an outlet, a second rotatable roller opposed to the first roller, and a driver for rotating the first and the second rollers in opposite directions to each other. Such arrangement enables the ball released on the circular runway to be accelerated thereon.

Another patent of interest is U.S. Pat. No. 4,911,448 which describes a spinner device designed for use in a game that tests both the imagination and association of one or more players. The spinner device is characterized by a frame designed to pivotally receive a disk, wherein the disk is manually pivoted with respect to the frame to indicate a letter of the alphabet at random.

Other relevant documents include U.S. Pat. Nos. 3,759,524, and 4,206,921.

While these devices fulfill their respective, particular objectives and requirements, the aforementioned patents do not disclose a rotatable gaming device for randomly selecting data through analog means which includes a base assembly supporting a rotatable platform in which a rotatable center shaft projects through the platform and supports both a cup member and a pointer, whereby the pointer and the platform may be caused to rotate in opposite directions with respect to the base assembly. Furthermore, none of the known prior art chance devices include additional gaming covers which may be magnetically engaged to the rotatable platform to change the indicia contained thereon and a storage compartment for storing such additional gaming covers.

In these respects, the rotatable gaming device according to the present invention substantially departs from the conventional concepts and designs of the prior art, and in so doing provides an apparatus primarily developed for the purpose of randomly selecting data through analog means.

SUMMARY OF THE INVENTION

In view of the foregoing disadvantages inherent in the known types of chance devices now present in the prior art, the present invention provides a new rotatable gaming device construction wherein the same can be utilized for randomly selecting data through analog means. As such, the general purpose of the present invention, which will be described subsequently in greater detail, is to provide a new rotatable gaming device apparatus which has many of the advantages of the chance devices mentioned heretofore and many novel features that result in a rotatable gaming device which is not anticipated, rendered obvious, suggested, or even implied by any of the prior art chance devices, either alone or in any combination thereof.

To attain this, the present invention essentially comprises a rotatable gaming device for randomly selecting data through analog means. The device includes a base assembly which supports a rotatable platform having a plurality of indicia thereon. A rotatable center shaft projects through the platform and supports a cup member at a top end thereof. A point is secured to the center shaft in a plane parallel to that defined by the platform. The device may be utilized for playing a game in which a bet, such as poker chips, money, or the like, is placed in the cup and the pointer is caused to rotate with respect to the platform, whereby a portion of the bet may be won by opposing players as a result of the relative placement of the pointer with respect to the platform as indicated by the indicia upon a termination of the motion. Alternate embodiments of the present invention include additional gaming covers which may be magnetically engaged to the rotatable platform to change the indicia contained thereon and a storage compartment for storing such additional gaming covers.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new rotatable gaming device apparatus which has many of the advantages of the chance devices mentioned heretofore and many novel features that result in a rotatable gaming device which is not anticipated, rendered obvious, suggested, or even implied by any of the prior art chance devices, either alone or in any combination thereof.

It is another object of the present invention to provide a new rotatable gaming device which may be easily and efficiently manufactured and marketed.

It is a further object of the present invention to provide a new rotatable gaming device which is of a durable and reliable construction.

An even further object of the present invention is to provide a new rotatable gaming device which is susceptible of a low cost of manufacture with regard to both materials and labor, and which accordingly is then susceptible of low prices of sale to the consuming public, thereby making such rotatable gaming devices economically available to the buying public.

Still yet another object of the present invention is to provide a new rotatable gaming device which provides in the apparatuses and methods of the prior art some of the advantages thereof, while simultaneously overcoming some of the disadvantages normally associated therewith.

Still another object of the present invention is to provide a new rotatable gaming device for randomly selecting data through analog means.

Yet another object of the present invention is to provide a new rotatable gaming device that includes a base assembly supporting a rotatable platform having a plurality of indicia thereon and a rotatable center shaft which projects through the platform and supports a pointer in a plane parallel to that defined by the platform, whereby the pointer and the platform may be rotated in opposite directions with respect to the base assembly.

Still yet another object of the present invention is to provide a new rotatable gaming device which includes additional gaining covers that may be magnetically engaged to the rotatable platform to change the indicia contained thereon.

Even still yet another object of the present invention is to provide a new rotatable gaming device which includes a storage compartment for storing additional gaming covers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
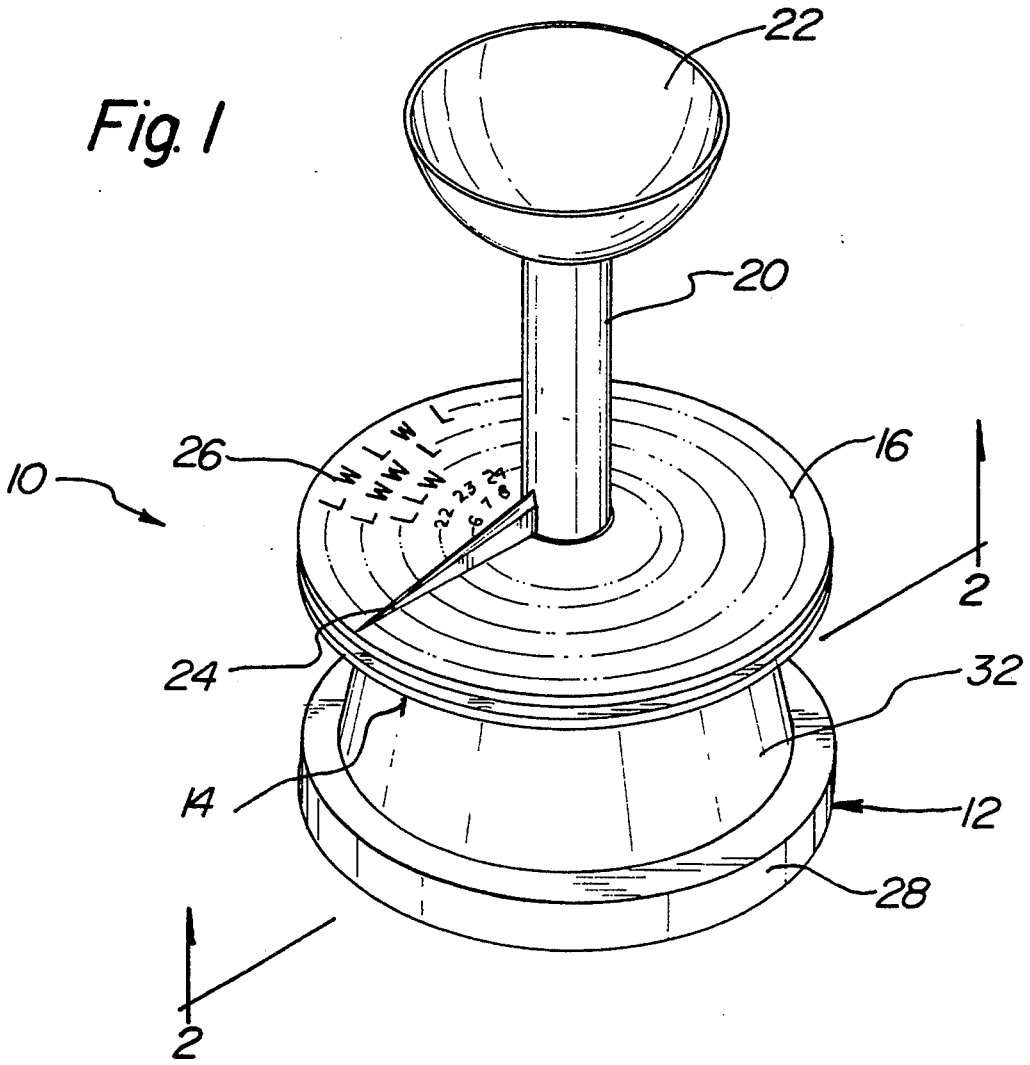
FIG. 1 is a perspective view of a rotatable gaining device comprising the present invention.
Figure 2:
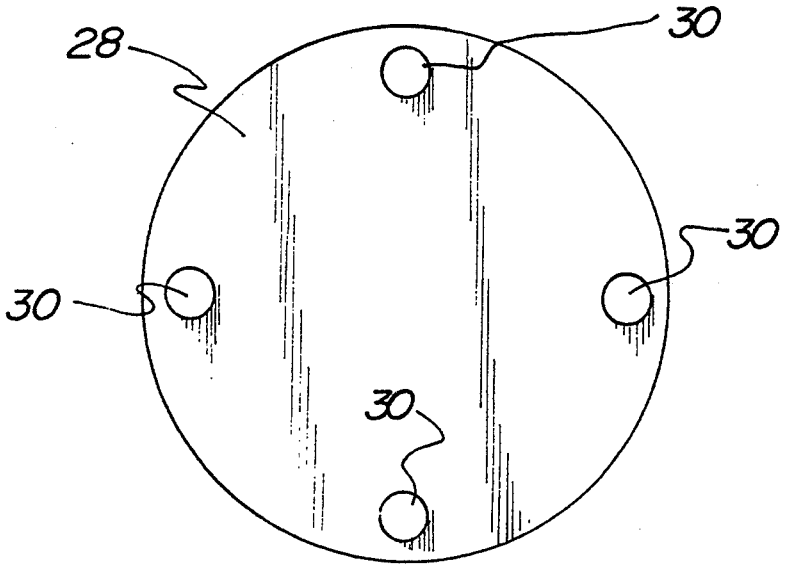
FIG. 2 is a bottom plan view of the present invention.

With reference now to the drawings, and in particular to FIGS. 1–4 thereof, a first embodiment of a new rotatable gaming device embodying the principles and concepts of the present invention and generally designated by the reference numeral 10 will be described.

Figure 3:
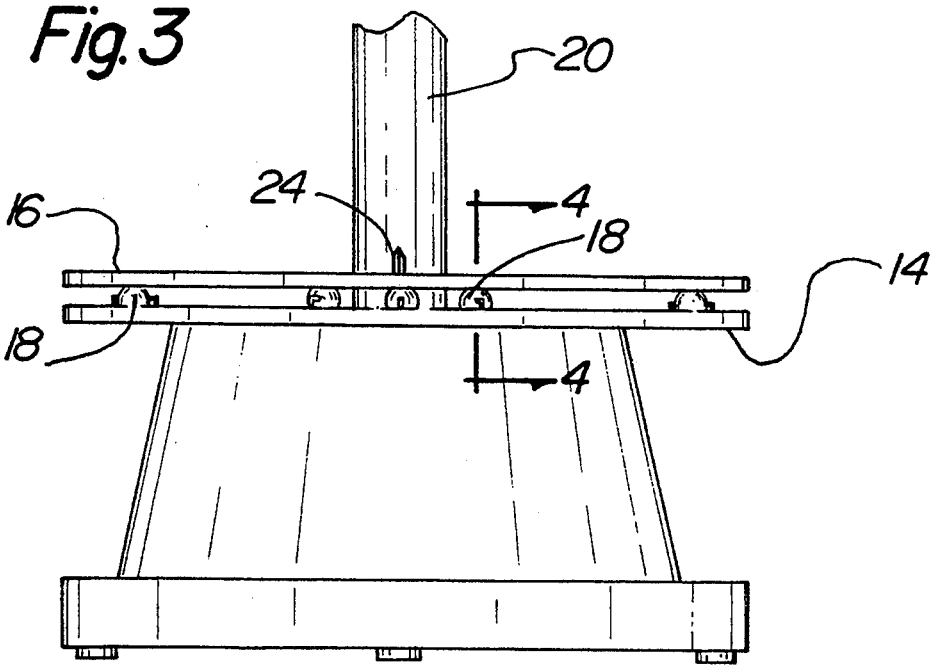
FIG. 3 is a side elevation view of a portion of the invention.

The rotatable gaming device 10 comprises a base assembly 12 which supports a stationary platform 14 in a spaced relationship to a surface upon which the base assembly is residing. As best illustrated in FIG. 3, a rotatable platform 16 is positioned in a spaced relationship to the stationary platform 14 upon a plurality of ball bearings 18 which permit a relative rotation between the two platforms. A center shaft 20 projects through unlabeled apertures in both of the platforms 14, 16 where it is rotatably supported by the base assembly 12. A cup member 22 is disposed upon a top end of the center shaft 20 and is operable to receive a bet, such as poker chips, money, or the like. The center shaft 20 further supports a pointer 24 in a parallel relationship to the platforms 14, 16 and operable to rotate with the center shaft, such that the center shaft and its associated pointer may be rotated in a direction opposite to that imparted to the rotatable platform. A plurality of indicia 26 is positioned in radially increasing concentric groups upon the rotatable platform 16 to be selected by the ultimate positioning of the pointer with respect to the rotatable platform.

In use, the rotatable gaming device 10 may be utilized to play any of a number of conceivable games as determined by the indicia 26 contained upon the rotatable platform 16 and the relative rotation created by a player between the pointer 24 and the platform.

More specifically, it will be noted that the rotatable gaming device 10 comprises a base assembly 12 having a truncated cylindrical base 28 provided with a plurality of resilient bumpers 30 on a bottom area thereof which permit the device 10 to be steadfastly positioned upon a surface such as a table or the like. The cylindrical base 28 is integrally or otherwise connected to a tapered column 32 which projects upward from the cylindrical base and supports the stationary platform 14 in a plane substantially parallel to the surface.

Figure 4:
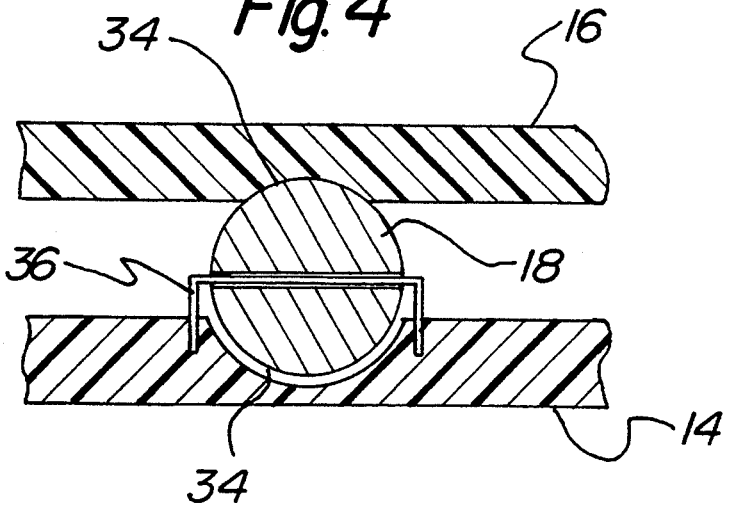
FIG. 4 is a cross sectional view taken along line 4—4 of FIG. 3.

The rotatable platform 16 is supported upon a plurality of ball bearings 18 in a spaced relationship to the stationary platform 14. As best illustrated in FIG. 4, it can be shown that the platforms 14, 16 each include an equal number of ball bearing recesses 34 into which a portion of each of the ball bearings 18 may project. The recesses 34 are operable to provide a greater area of contact between the ball bearings 18 and the platforms 14, 16, thereby reducing wear between these components. The ball bearings 18 are each rotatably secured within the recess 34 by a ball bearing axle 36 which is formed of a thin strand of U-shaped wire or other material that passes through an unlabelled aperture in each ball bearing and engages the stationary platform 14. This arrangement precludes a loss of the ball bearings 18 upon a rough handling of the device 10, while still allowing the platforms 14, 16 to easily rotate with respect to each other.

The center shaft 20 projects through unlabelled apertures in both of the platforms 14, 16, whereby it is rotatably supported by conventional means within the base assembly 12. The center shaft 20 is comprised of a substantially long, tubular member and is provided with the cup member 22 at a top end thereof. The cup member 22 is substantially hemispherically shaped and is operable to receive and contain a bet, such as poker chips, money, or the like. Fixably secured to the center shaft 20 is the pointer 24 which projects outwardly therefrom in a plane substantially parallel to that of the rotatable platform 16, as best illustrated in FIG. 1, such that the center shaft and its associated pointer may be rotated in a direction opposite to that imparted to the rotatable platform.

Indicia 26 is positioned upon the rotatable platform 16 and is arranged in concentric circular groups. Although the indicia 26 may comprise letters, numbers, or symbols having any conceivable meaning, the present invention 10 desires indicia comprising a plurality of the letter "L" and a plurality of the letter "W" arranged in radially increasing concentric circles upon the rotatable platform 16. The "L" is operable to indicate a loss and the "W" is operable to indicate a win. However, the letter "L" and the letter "W" may be associated with any conceivable definition. In the preferred embodiment, there are twenty four of the letter "L" and twenty four of the letter "W" alternatingly positioned in each of the concentric circles.

In use, the rotatable gaming device 10 may utilized to play any game desired. However, the device 10 is particularly suited for playing a game in which opposing players each place a bet, such as a poker chip, money, or the like, within the cup member 22 of the device. The players then take alternating turns by spinning the center shaft 20 in a first direction and the rotatable platform 16 in a second direction. Alternatively, a turn may be taken by rotating either the center shaft 20 or the rotatable platform 16 only. The player must then indicate which of the concentric groups of indicia 26 should be read by a verbal communication of the same to the opposing player, whereby the outer most concentric ring is taken as the default reading should no indication be given.

After the center shaft 20 and/or the rotatable platform 16 have been rotated and have come to a stop, the outcome of the play as determined by the position of the pointer 24 with respect to the rotatable platform 16 and by the particular group of indicia 26 chosen by the player is recorded. If the pointer 24 points to the letter "L", the turn is designated a loss and the player puts in another bet. If the pointer 24 points to the letter "W", the turn is designated a win and the player removes one of the bets from the cup member 22.

Although the present invention 10 has been described as having a rotatable platform 16 in which the indicia 26 contained thereon comprises twenty-four of the letter "L" and twenty-four of the letter "W", other combinations of letters may be used as well. For example, the indicia 26 may comprise twenty of the letter "L" and twenty-eight of the letter "W", sixteen of the letter "L" and thirty-two of the letter "W", or eight of the letter "L" and forty of the letter "W".

Figure 5:
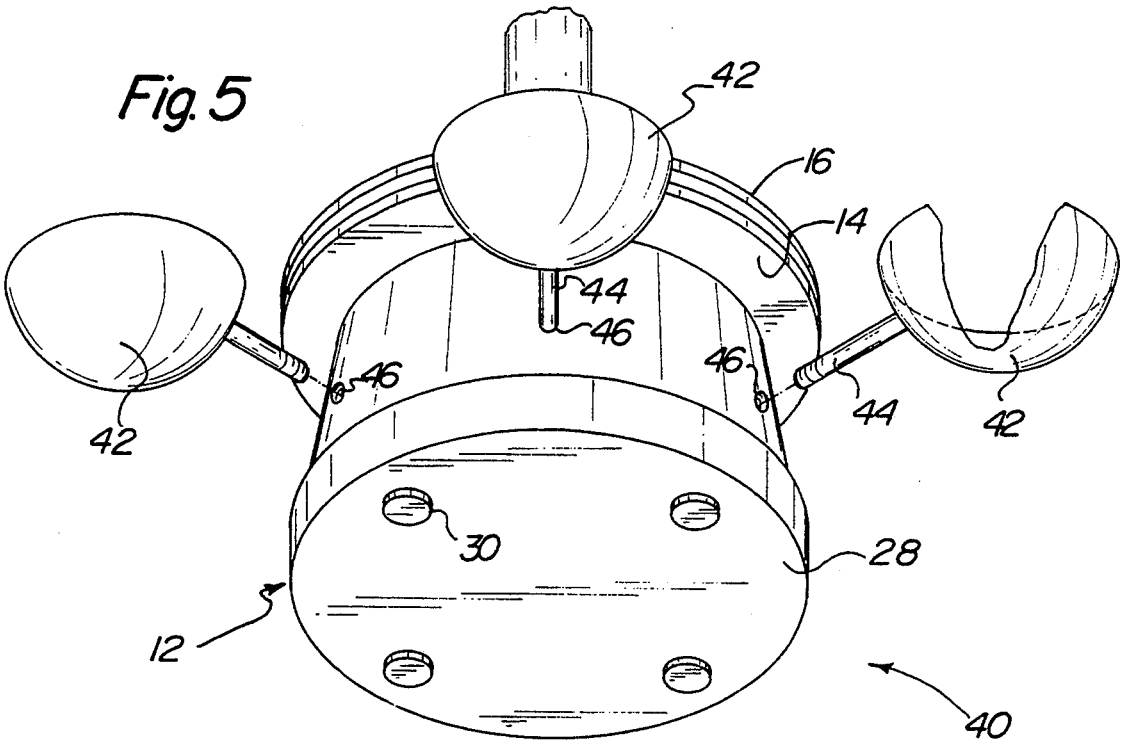
FIG. 5 is a bottom perspective view of a second embodiment of a rotatable gaming device comprising the present invention.

A second embodiment of the present invention as generally designated by the reference numeral 40, which comprises substantially all of the features of the foregoing embodiment 10 and which further comprises additional cup members 42 will now be described. As best illustrated in FIG. 5, it can be shown that the additional cup members 42 each comprise a substantially hemispherically shaped member similarly shaped to the cup member 22 and having a support rod 44 fixedly secured thereto. The support rod 44 is provided with unlabelled threads at a distal end thereof which are operable to engage cooperating threads within base apertures 46 positioned in a radially spaced relationship to one another around an exterior of the base assembly 12. The additional cup members 42 are each operable to retain the unused bets of each player and may be produced in various colors for allowing the cup members to be distinguished from one another.

Figure 6:
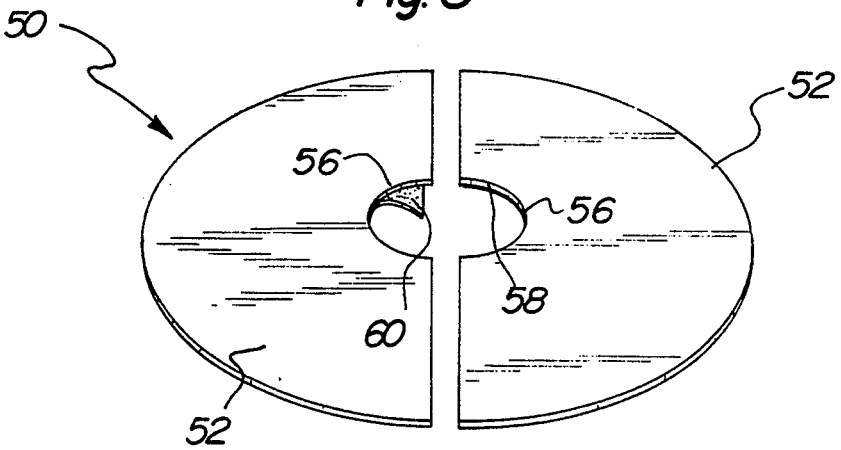
FIG. 6 is a perspective view of a portion of a third embodiment of a rotatable gaming device comprising the present invention.
Figure 7:
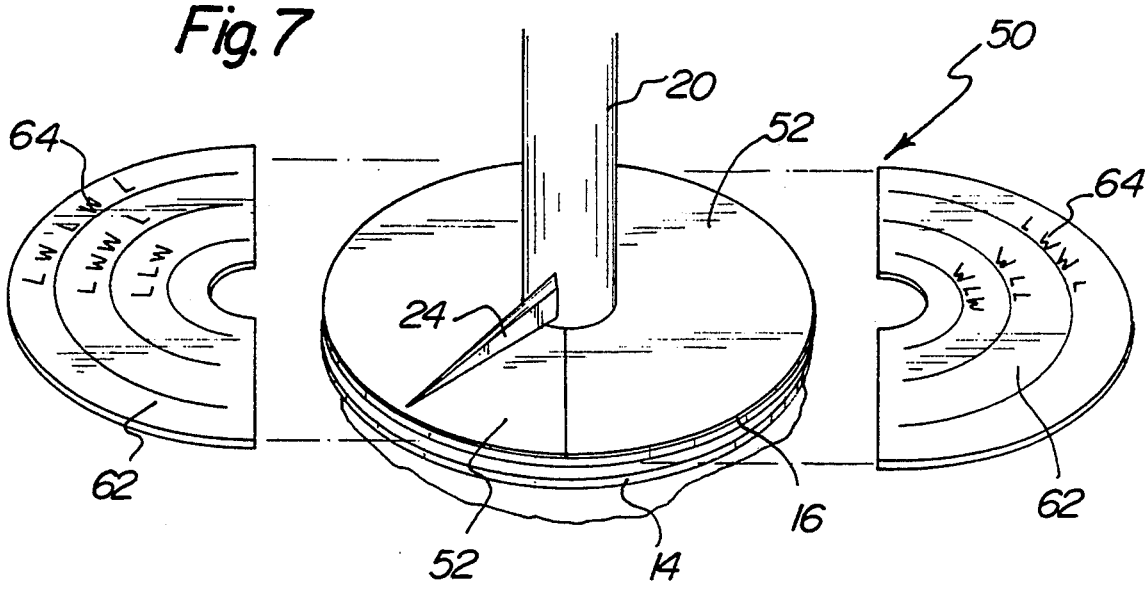
FIG. 7 is a further perspective view of a further portion of the third embodiment.
Figure 8:
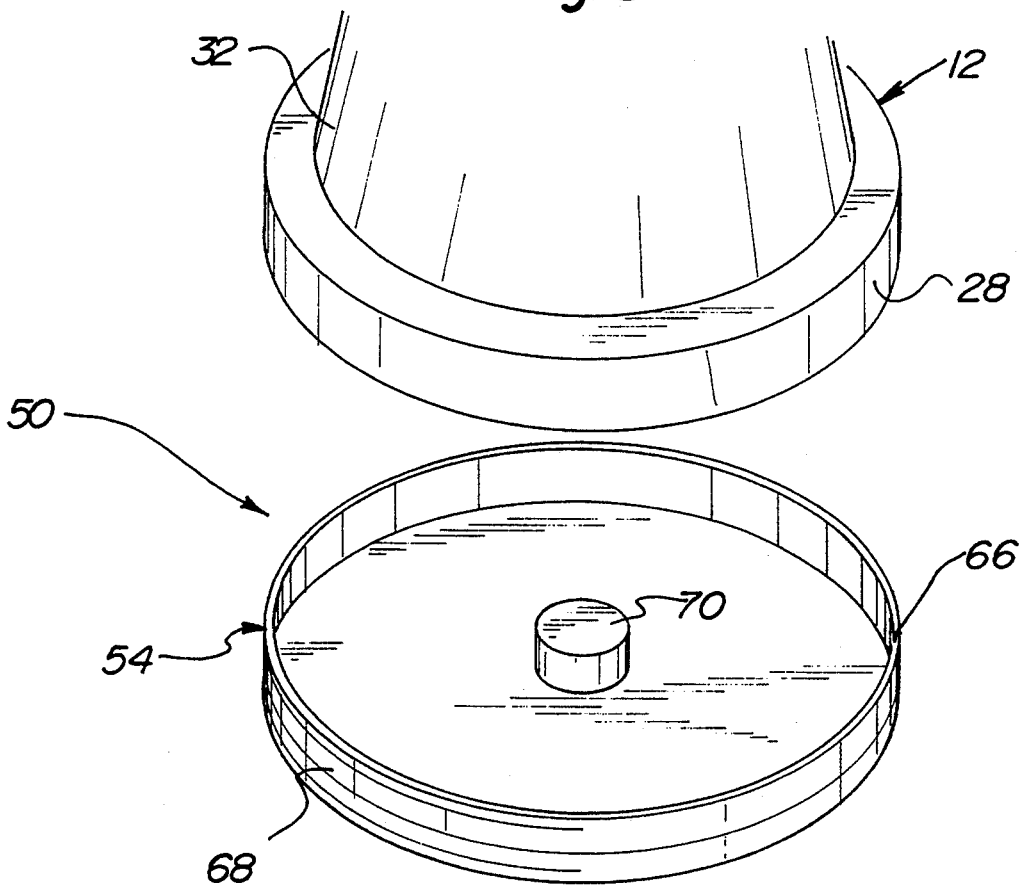
FIG. 8 is an enlarged perspective view, partially exploded, of an even further portion of the third embodiment.

Comprising all of the features and structure of the previous embodiments 10, 40 is a third embodiment which is generally designated by the reference numeral 50 and may be viewed in FIGS. 6–8. It can be shown that the third embodiment 50 further comprises a pair of magnetic platform covers 52 and a releasable storage container 54. The pair of magnetic platform covers 52 are each comprised of a substantially magnetic material having a semi-circular shade in which a cut-out 56 is defined. The platform covers 52 further comprise an adhesive 58 which may be exposed by a removal of a backing 60, whereby the platform covers may then be secured to the rotatable platform 16. The cutout 56 in each of the magnetic platform covers 52 allows the covers to be engaged to the rotatable platform 16 without intersecting the center shaft 20. The platform covers 52 are operable to magnetically engage additional gaming covers 62 having additional indicia 64 thereon. In this manner, the indicia 26 on the rotatable platform 16 may be changed to the additional indicia 64 of the additional gaming covers 62, whereby different games may be played.

The releasable storage container 54 of the third embodiment 50 comprises a cylindrical cap 66 having threads 68 encompassing an exterior perimeter thereof which are operable to engage cooperating, unlabelled threads within the cylindrical base 28 of the base assembly 12. The cylindrical cap 66 further comprises a center post 70 in a center area thereof which facilitates a centered, organized placement of the additional gaming covers 62 within the releasable storage container 54.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new rotatable gaming device comprising:

a base positionable upon a surface;

a stationary platform secured to said base in a parallel relationship to said surface, said stationary platform having a through-extending aperture in a center area thereof;

a plurality of ball bearings;

a rotatable platform positioned in a spaced, parallel relationship to said stationary platform and supported thereon by said plurality of ball bearings, said rotatable platform having a through-extending aperture in a center area thereof;

indicia positioned upon said rotatable platform;

a center shaft projecting through said apertures and rotatably supported by said base orthogonal to said surface, said center shaft having a top end;

a pointer fixedly secured to said center shaft and extending outwardly therefrom in a plane parallel to said rotatable platform;

and, a cup member supported upon said top end of said center shaft.

2. The new rotatable gaining device of claim 1, and further comprising through-extending apertures in each of said ball bearings, and a plurality of U-shaped ball bearing axles, each of said axles passing through said apertures in said ball bearings and engaging said stationary platform.

3. The new rotatable gaming device of claim 2, and further comprising an additional cup member; a support rod fixedly secured to said additional cup member; threads formed along a portion of said rod; and a threaded aperture in said base operable to threadably receive and support said support rod parallel to said surface.

4. The new rotatable gaming device of claim 3, and further comprising a platform cover having an adhesive for securing said platform cover to said rotatable platform, said cover being comprised of a substantially magnetic material.

5. The new rotatable gaming device of claim 4, and further comprising an additional gaming cover having different indicia positioned thereon, said additional gaming cover being formed of a substantially ferrous material and operable to be releasably engaged to said platform cover.

6. The new rotatable gaming device of claim 5, and further comprising a storage container means releasably secured to said base for storing said additional gaming cover.

7. The new rotatable gaming device of claim 1, wherein said indicia comprises a plurality of the letter "L" and a plurality of the letter "W" arranged in a concentric, circular manner.

8. The new rotatable gaming device of claim 7, wherein said indicia means comprises twenty four of the letter "L" and twenty-four of the letter "W".

9. The new rotatable gaming device of claim 7, wherein said indicia means comprises twenty of the letter "L" and twenty-eight of the letter "W".

10. The new rotatable gaming device of claim 7, wherein said indicia comprises sixteen of the letter "L" and thirty-two of the letter "W".

* * * * *